United States Patent [19]

Liao

[11] Patent Number: 4,831,853

[45] Date of Patent: May 23, 1989

[54] CYLINDRICAL KEY AND METHOD FOR ITS PRODUCTIONS

[76] Inventor: Wu-Chang Liao, No. 18 Alley 5 Lane 42 Tien Hsiang Street, Hsin Chuang, Taipei 24234, Taiwan

[21] Appl. No.: 199,293

[22] Filed: May 26, 1988

[51] Int. Cl.[4] ..... E05B 27/08; E05B 19/04

[52] U.S. Cl. ..... 70/491; 70/408

[58] Field of Search ..... 70/491, 408, 395, 402, 70/403, 404

[56] References Cited

U.S. PATENT DOCUMENTS 1,984,202 12/1934 Shinn ..... 70/491

2,226,355 12/1940 Hofmann ..... 70/491

FOREIGN PATENT DOCUMENTS 35270 7/1929 France ..... 70/408

*Primary Examiner*—Robert L. Wolfe

*Attorney, Agent, or Firm*—Ladas & Parry

[57] ABSTRACT

An improved cylindrical key comprising a key plate having two small fixing protrusions and a leg-shaped extension plate formed at one-side end portion thereof, and a key cylinder having a greater cylinder section provided with a radial elongated hole for receiving said leg-shaped extension plate, a smaller cylinder section provided with a cross slot arranged in alignment with said radial elongated hole for engagement of said side end portion of said key plate, and a communicating with the inner step bore of said cylinder sections for firmly securing said two fixing protrusions when the latter are inserted into said inner step bore through said cross slot, and outwardly bent and rested on the inner step slope wall of said inner step bore.

A method of producing said cylindrical key comprising: uprightly holding said key plate by means of a die base; letting said inner step bore of said cylinder sections of said key cylinder engaged with said fixing protrusions of said key plate, and said wing portion and key portion of said key plate engaged with said elongated hole of said key cylinder; and letting said fixing protrusions outwardly bent and rested on the inner step slope wall of said inner step wall by means of a punch of a press, in order to firmly secure said key cylinder onto said key plate, and to obtain said cylindrical key.

3 Claims, 3 Drawing Sheets

CYLINDRICAL KEY AND METHOD FOR ITS PRODUCTIONS

BACKGROUND OF THE INVENTION

The present invention relates to an improved cylindrical key and method for its production.

In the production of the early cylindrical key as shown in FIG. 1, a key cylinder 32 is produced by means of a lathe from a metal bar having an axial protrusion rib 321 formed on the periphery thereof, and a groove 322 is then formed on the said protrusion rib by means of a milling machine and an inward protruding key 324 is formed on the cylinder wall below the groove 322 by means of a press. Alternatively, as shown in FIG. 2, the said key cylinder is produced by means of a lathe from a circular cross-section metal bar, and an outward protruding wing 323 and an inward protruding key 324 are formed on the cylinder wall by means of a press. The key cylinder 32 is then secured onto a key plate 31 by means of welding or press fit in order to form a cylindrical key 30. However, such production method has following disadvantages:

(1) It is difficult to process a cylinder with a protrusion rib by means of lathe tool, and hence its production rate is low, and the wear of used lathe tool is great, and its rejection rate is too high, because the cost for forming metal bar is very high, and the accuracy of its outer diameter dimension is difficult to control.

(2) The outward protruding wing 323 and the inward protruding key 324 will be stuck in the groove of the die during press work. This will cause a difficult withdrawal of the work piece, a difficult press work and a difficult control of the product accuracy. In addition, the outward protruding wing 323 and the inward protruding key 324 can not be formed at the same time, and hence the total production cost is increased. In view of these disadvantages, an improved production method is used in substitution for such production method.

In an improved production of a conventional cylindrical key 20 which is also comprised of a key plate 21 and a key cylinder 22. The key plate 21 comprises a plate 210 which is formed with a square hole 211 at one end thereof, and has a protrusion part 212 formed, which comprises an outward protruding wing 213 and an inward protruding key 214. The key cylinder 22 is made of a solid circular cross-section bar, and processed by means of the lathe work in order to form a cylinder 220 with a reduced solid bar end 221 for engagement with the lock hole 811 and the spindle 82 of a lock 80 (as shown in FIG. 1), and the square hole 211 of the key plate 21 respectively. The solid bar end 221 is formed with a cross groove 224 by means of the milling work, which has a width corresponding to the thickness of the key plate 21. The cylinder 220 is formed with a rectangular hole 223 opposite to the cross groove 224 of the solid bar end 221 by means of the press work. When in assembly, the protrusion part 212 is inserted into the rectangular hole 223 of the key cylinder 22 with a small groove 215 between the outward protruding wing 213 and the inward protruding key 214 rested against the cylinder wall of the rectangular hole 223, and also with the square hole 211 of the plate 210 inserted into the cross groove 224 of the key cylinder 22. The two side walls of the cross groove 224 are then pressed by a press in order to firmly hold the key plate 21, and to finish the assembly of a cylindrical key 20. However, such production method has following disadvantages: (1) The fixation of key plate and key cylinder is not firm, because only a small part of the end wall of the square hole 211 of the key plate 21 is held by the two side walls of the cross groove 224 of the key cylinder 22, hence a loose fixation will be produced after they have been used for a short period. (2) When it is in assembly, the two side walls of the cross groove of the key cylinder should be pressed by the press and rely on each other. This will cause a pressing trace in the surfaces of the said two side walls, which will damage the beauty of the surface of the key cylinder. Furthermore, the key plate 210 will be pressed, bent and deformed if the adjustment of the die set is improper. (3) If the key plate 21 and key cylinder 22 are assembled by means of press work after their electro-plating surface treatments are finished, the electro-plating film on the pressing trace 226 will be broken and removed therefrom. This will damage its beauty and result in corrosion. However, if the key plate 21 and key cylinder 22 are assembled before their electro-plating surface treatments are finished it will be difficult to obtain an even electro-plating surface. (4) When it is in assembly, the key plate and the key cylinder can only be assembled after the protrusion part 212 of the key plate 21 has been slantingly inserted into the rectangular hole 223 of the key cylinder 22 by means of operator's hands, and the inner wall of the small groove 215 between the outward protruding wing 213 and the inward protruding key 214 rests on the end wall of the rectangular hole 223, and the square hole 211 of the plate 210 has been inserted into the cross groove of 224 the solid bar end 221. Hence, an automatic assembly can not be obtained.

The present invention aims at eliminating the above said disadvantages, and provides an improved method of producing a cylindrical key.

The present invention will become fully apparent from the detailed description with reference to the accompanying drawings which are given by way of illustration only, and thus are not limitative of this invention.

DETAILED DESCRIPTION OF PREFERRED EMBODIMENT

Figure 1:
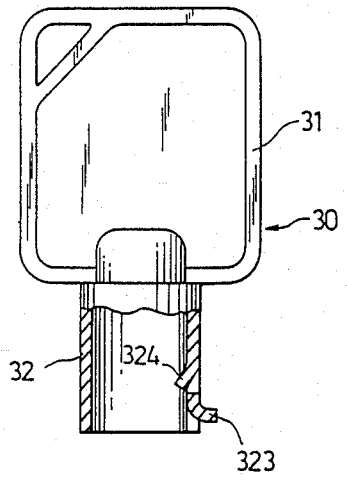
Fig.1 (PRIOR ART)
FIG. 1 is a partial-sectional front view of an early cylindrical key which is made from a metal bar.
Figure 2:
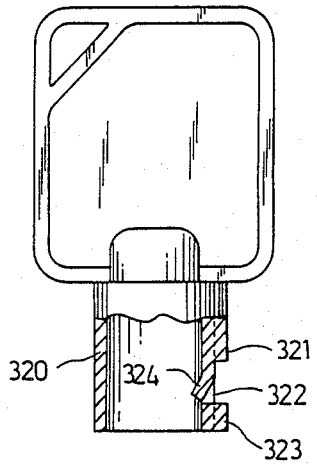
Fig.2 (PRIOR ART)
FIG. 2 is a partial-sectional front view of another early cylindrical key which is made from a circular cross-section metal bar.
Figure 3:
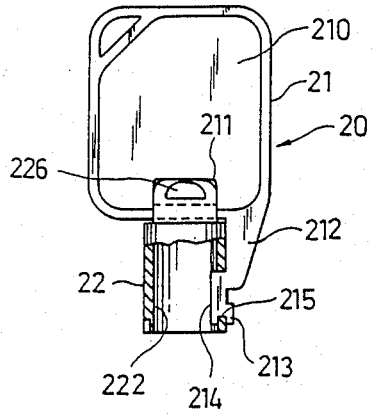
Fig.3 (PRIOR ART)
FIG. 3 is a partial-sectional front view of a conventional cylindrical key.
Figure 5:
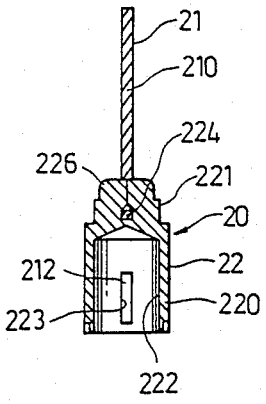
Fig.5 (PRIOR ART)
FIG. 5 is a longitudinal sectional view of FIG. 3.
Figure 4:
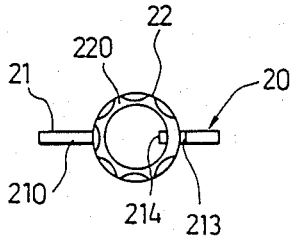
Fig.4 (PRIOR ART)
FIG. 4 is a bottom view of FIG. 3.

As shown in FIGS. 6–11, a cylindrical key 10 made in accordance with the present invention is also comprised of a key plate 11 and a key cylinder 12. However, in the present invention, the key plate 11 comprises a plate 110 having a suitable thickness and shape, two small fixing protrusions 111, and a leg-shaped extension plate 112 formed at one side end portion thereof. The leg-shaped extension plate 112 is intergrally formed with an outer wing portion 113 and an inner key portion 114. The key cylinder 12 is made of a solid circular cross-section bar which is processed and integrally formed with an inner step bore 125 and an outer step periphery which form a greater integral cylinder portion 120 and a smaller integral cylinder portion 122, by means of a lathe for engagement of an annular key hole 811 of a lock 80.

The greater cylinder portion 120 of the key cylinder 12 is provided with a radial elongated hole 123 for receiving the extension plate 112 of the key plate 11, while the smaller cylinder portion 122 of the key cylinder 12 is also provided with a cross slot 124 which is arranged in alignment with elongated hole 123, for engagement of the key plate 11, and also an inner step bore 125 communicating elongated hole 123 and cross slot 124, for receiving the fixing protrusions 111 of the key plate 11. When it is in assembly, the key plate 11 is first inserted into a die base 50, with its extension plate 112 exposed; and the key cylinder 12 is then put on the key plate 11, with its inner hole 125 engaged with the fixing protrusions 111 of the key plate 11 as shown in FIG. 7, and its outer wing portion 113 and inner key portion 114 engaged with the elongated hole 123 of the key cylinder 12; and the two fixing protrusions are then outwardly bent and rest on the inner step slope wall 126 of the inner step bore 125 by means of an automatic press as shown in FIG. 8, and a firm and beautiful cylindrical key 10 is thus obtained.

Figure 6:
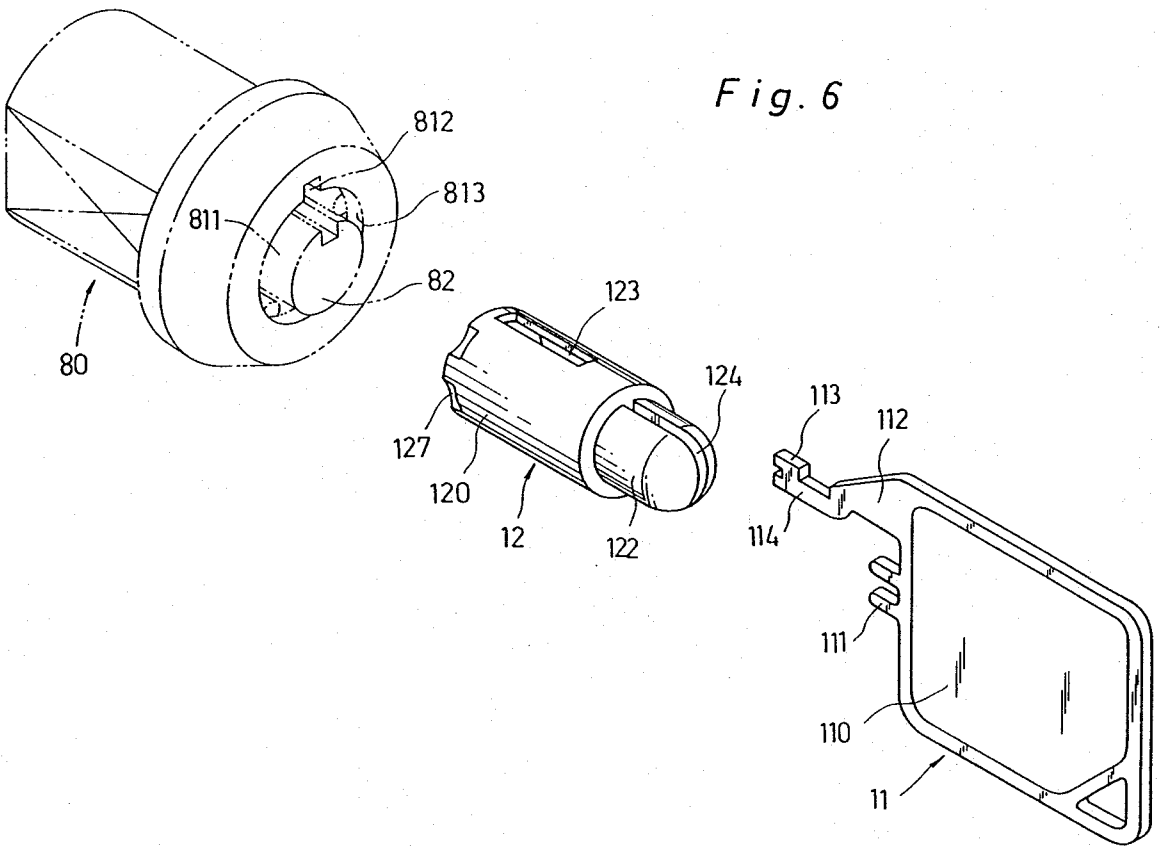
FIG. 6 is an exploded view of a cylindrical key according to the present invention.

When it is in use, the annular edge of the key cylinder 12 is formed with a plurality of key teeth 127 of different depths corresponding to the different position of the locking pins of a lock 80 (as shown in FIG. 6) by means of the milling machine, so that it can be inserted into the lock hole 811 of said lock 80, with the wing portion 113 inserted into the notch 812, and the spindle 82 of said lock 80 can be rotated by the key portion 114.

Figure 7:
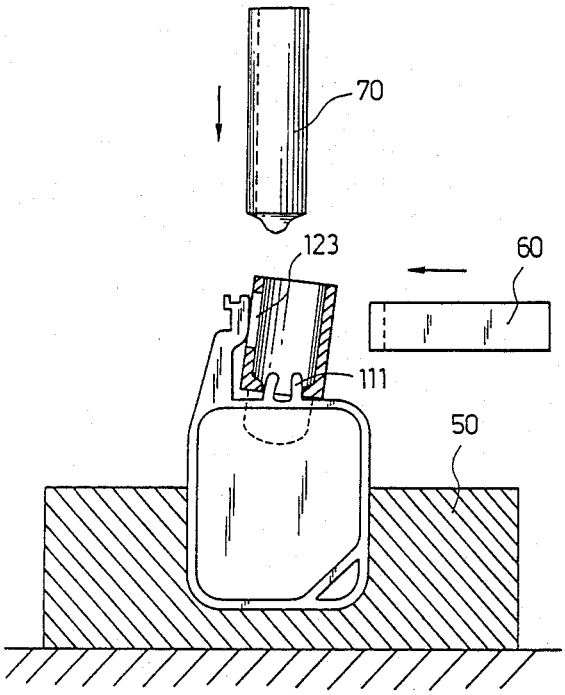
FIG. 7 is a partial-sectional view showing the automatic assembly of a cylindrical key of FIG. 6.
Figure 9:
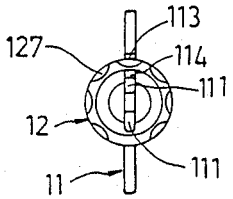
FIG. 9 is a top view of FIG. 8.
Figure 10:
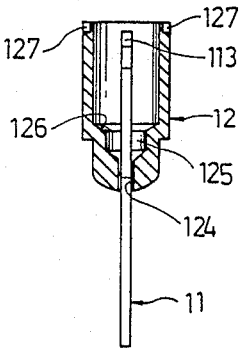
FIG. 10 is a longitudinal sectional side view of FIG. 8.
Figure 8:
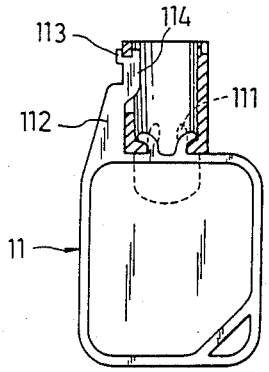
FIG. 8 is a partial-sectional front view of a cylindrical key according to the present invention, showing the two fixing protrusions which have been laterally bent.
Figure 11:
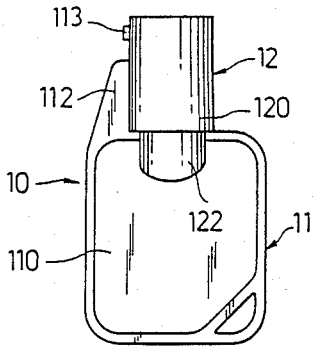
FIG. 11 is a front view of a cylindrical key according to the present invention.

As shown in FIG. 7 the cylindrical key according to the present invention is suitable for automatic assembly. The key plate 11 is partially inserted into a die base, with its leg-shaped extension plate 112 exposed. The key cylinder 12 is then put on the fixing protrusion 111 of the key plate 11 and moved to an upright position by means of an automatic mechanical arm 60, and then rested on the extension plate 112, with its wing portion 113 and key portion 114 inserted into the elongated hole 123 of the key cylinder 12. At this time, the two fixing protrusions of the key plate are outwardly bent and rested on the inner step slope wall 126 of the inner step bore 125 of the key cylinder 12 by means of a punch 70. These operations can be effected by means of an automatic mechanical arm and an autofeeder, in order to attain automatic production. It should be noted that the fixing protrusions 11 may be slightly inwardly bent in order to enable the key cylinder 12 to be automatically engaged with the fixing protrusion 111 of the key plate 111.

The major feature of the present invention resides in that the wing portion 113, key portion 114 and fixing protrusions 111 are integrally formed on the key plate 11 by means of a press which is suitable for automatic mass production. This is contrary to the prior art in which the wing portion and the key portion are formed on the key cylinder 120, which must be processed by means of a lathe which is not suitable for automatic mass production. Hence, the cylindrical key according to the present invention can be mass produced, and the electro-plating surface treatment of its parts e.g. key cylinder and key plate etc. can be done before assembly without damages to its surface. Since the bottom wall of the greater cylinder portion 120 of the key cylinder 12 is firmly fixed and rested on the key plate 11 by means of the fixing protrusion 111 (as shown in FIGS. 7 and 8), the fixation of its parts will not be loosened during use, and a firm and beautiful cylindrical key can be obtained.

I claim:

1. An improved cylindrical key comprising a key plate and a key cylinder secured onto said key plate, characterized in that said key plate has two small fixing protrusions and a leg-shaped extension plate formed at one side end portion thereof, said extension plate is integrally formed with an outer wing portion and an inner key portion, said key cylinder is interally formed with an inner step bore and an outer step periphery which form two integral greater and smaller cylinder portions, said greater cylinder portion is provided with a radial elongated hole for receiving said leg-shaped extension plate and said smaller cylinder portion is provided with a cross slot which is arranged in alignment with said radial elongated hole, for engagement of said side end portion, and communicates with said inner step bore, for firmly securing said two fixing protrusions when the latter are inserted into said inner step bore through said cross slot, and outwardly bent and rest on the inner step slope wall of said inner step bore.

2. A method of producing a cylindrical key according to claim 1, which comprises: preparing a key plate having two small fixing protrusions and a leg-shaped extension plate, integrally formed at one side end portion thereof, and a key cylinder integrally formed with an inner step bore and an outer step periphery form two integral greater and smaller cylinder portions respectively provided with a radial elongated hole and a cross slot arranged in alignment with said elongated hole; uprightly holding said key plate by means of a die base; letting said inner step bore engaged with said fixing protrusions, and said wing portion and key portion engaged with said elongated hole and letting said fixing protrusions outwardly bent and rested on the inner step slope wall of said inner step bore by means of a punch of a press, in order to firmly secure said key cylinder onto said key plate, to obtain said cylindrical key.

3. A method as claimed in claim 2, wherein said fixing protrusions are slightly inwardly bent before insertion into said inner step bore of said key cylinder.

* * * * *